US009403627B1

(12) United States Patent
Scott et al.

(10) Patent No.: US 9,403,627 B1
(45) Date of Patent: Aug. 2, 2016

(54) COUPLER FOR SECURING AN OBJECT TO A STRUCTURAL SUPPORT MEMBER THROUGH A VOID

(71) Applicants: William M. Scott, Bonita Springs, FL (US); Gihoon Song, Bonita Springs, FL (US)

(72) Inventors: William M. Scott, Bonita Springs, FL (US); Gihoon Song, Bonita Springs, FL (US)

( * ) Notice: Subject to any disclaimer, the term of this patent is extended or adjusted under 35 U.S.C. 154(b) by 0 days.

(21) Appl. No.: 14/721,315

(22) Filed: May 26, 2015

Related U.S. Application Data

(60) Provisional application No. 62/135,484, filed on Mar. 19, 2015.

(51) Int. Cl.
*B65D 45/18* (2006.01)
*B65D 5/66* (2006.01)

(52) U.S. Cl.
CPC ..... *B65D 45/18* (2013.01); *B65D 5/6611* (2013.01)

(58) Field of Classification Search
CPC .... B65D 45/18; B65D 5/6611; B65D 5/6673; B65D 5/643; B65D 5/46024; B65D 45/16
USPC ..... 215/273, 280, 287, 290; 229/125.39, 229/125.37, 125.41; 24/298, 300–302
See application file for complete search history.

(56) References Cited

U.S. PATENT DOCUMENTS 2,828,905 A * 4/1958 Frizzell ..... B65D 5/448 229/125.38
4,021,890 A * 5/1977 Kurosaki ..... F16B 2/02 16/443
4,067,493 A * 1/1978 Stavin ..... B65D 5/68 206/8
4,176,423 A * 12/1979 Wigemark ..... B65D 5/46024 16/405
6,014,850 A * 1/2000 LeMire ..... B31B 1/86 220/754
6,926,192 B1 * 8/2005 Dowd ..... B65D 5/3621 229/117

* cited by examiner

*Primary Examiner* — Abigail Morrell
(74) *Attorney, Agent, or Firm* — Patents on Demand P.A.; Brian K. Buchheit; Scott M. Garrett

(57) ABSTRACT

A coupler having a semi-rigid support member and two extrusions. The extrusions can be secured against opposing sides of a container. Each of the extrusions is fitted through a void on each of the opposing sides. The coupling can provide structural support when the extrusions are securely fitted into the void. Each of the extrusions can include an insertable end, a non-insertable end, a trunk, and a set of tertiary pawls extending from the trunk and the primary pawl. The tertiary pawls can be positioned between the insertable and non-insertable ends along a longitudinal axis of the coupler. The insertable end can be able to fit through a void from the frontside to the backside. The trunk can terminate at the insertable end in the primary pawl. The base pawl can be able to be secure the coupler against the frontside surface of the void.

3 Claims, 6 Drawing Sheets

Embodiment 110

*Isometric View 111*

Embodiment 130

100A

Embodiment 110

*Isometric View 111*

Embodiment 130

100B

Embodiment 150

Embodiment 170

200

Embodiment 210

*Isometric View 211*

Embodiment 230

300

Embodiment 310

Embodiment 330

400

Embodiment 410

*Top View 411*

*Side View 431*

500

Embodiment 510

Embodiment 530

COUPLER FOR SECURING AN OBJECT TO A STRUCTURAL SUPPORT MEMBER THROUGH A VOID

CROSS-REFERENCE TO RELATED APPLICATION

This application claims priority to Provisional Application No. 62/135,484, entitled "Coupler for Securing an Object to a Structural Support Member Through a Void", filed Mar. 19, 2015, which is incorporated herein in its entirety.

BACKGROUND

The present invention relates to the field of and, more particularly, to a coupler for securing an object to a structural support member through a void.

A number of situations exist where a supporting structure having a void is used to mate/support material. Some objects (e.g., such as a nail) create the void in a structural surface while securing objects to the structure using an affixer that passes through the structural surface while creating a void. Other couplers, however, are designed to utilize an existing void, as the supporting coupler does not create the void on its own. These types of void dependent couplers can be permanent (e.g., non-releasable), releasable, or semi releasable in nature.

Conventional metal rivets are an example of a permanent coupler that utilizes a void filling. A wood screw (e.g., which generally expands a size of a void) is cross between a void creating and void filing coupler. Fixed diameter screws are void filling couplers having a tightly tailored void (e.g., must have screw threads matching the screw coupler). Plastic rivets are void filling couplers that are semi-removable depending on design.

It should be appreciated that although the plastic rivets (and similar couplers) come in multiple forms as known in the art, generally, the ability to reuse these couplers is limited, as use tends to deform their structure.

BRIEF SUMMARY

One aspect of the present invention can include an apparatus for a coupler for securing an object to a structural support member through a void. A coupler can have one or more semi-rigid support member and two or more extrusions. The extrusions can be secured against opposing sides of a container. Each of the extrusions can be fitted through a void on each of the opposing sides of the container. The coupling can provide structural support to the container when the extrusions are securely fitted into the void. Each of the extrusions can include an insertable end, a non-insertable end, a trunk, and a set of tertiary pawls extending from one or more trunks and one or more primary pawls. The tertiary pawls can be positioned between the insertable end and non-insertable end along a longitudinal axis of the coupler. The insertable end can be able to fit through a void from the frontside through the void to the backside of the void. The non-insertable end cannot be able to fit through the void. The trunk can terminate at the insertable end in the primary pawl. The primary pawl can form a supplementary angle to the trunk. The complementary angle can be at least five degrees. When the tertiary pawls are completely inserted into the void, the tertiary pawls can contact the backside surface associated with the void. The non-insertable end can terminate in a base pawl. The base pawl can form two supplementary angles to the trunk. The complementary angles can be at least five degrees. The base pawl can be able to secure the coupler against the the frontside surface of the void. The base pawl can be approximately parallel to the primary pawl.

Another aspect of the present invention can include an apparatus for a coupler for securing an object to a structural support member through a void. A coupler can include an elongate elastic member having a pair of opposite ends. The elastic member can have a relaxed stated from which the elastic member can be stretched to a stretched state. The elastic member can have a first length when in the relaxed state and a second length greater than the first length when in the stretched state. Each of the ends of the elastic member can have a fastener connected to the each of the ends. Each of the fasteners can include an insertable end, a non-insertable end, a trunk, and a set of tertiary pawls extending from the trunk and the primary pawl. The insertable end can be able to fit through a void from the frontside through the void to the backside of the void of a container. When the tertiary pawls are completely inserted into the void, the tertiary pawls can contact the backside surface associated with the void to secure the fastener within the void.

A coupler can have a semi-rigid trunk and one or more extrusions at each end of the trunk perpendicular to the trunk. Each of the extrusion can be secured against opposing sides of a container. Each of the extrusions is fitted through a void on each of the opposing sides of the container. The coupling can provide structural support to the container when the extrusions are securely fitted into the void. Each of the two extrusions can include an insertable end, a non-insertable end, and a set of tertiary pawls extending from the trunk and a primary pawl. The tertiary pawls can be positioned between the insertable end and non-insertable end along a longitudinal axis of the coupler. The insertable end can be able to fit through a void from the frontside through the void to the backside of the void. The non-insertable end cannot be able to fit through the void. The trunk can terminate at the insertable end in the primary pawl. The primary pawl can form a supplementary angle to the trunk. The complementary angle can be at least five degrees. When the tertiary pawls are completely inserted into the void, the tertiary pawls can contact the backside surface associated with the void. The non-insertable end can terminate in a base pawl. The base pawl can form two supplementary angles to the trunk. The complementary angles can be at least five degrees. The base pawl can be able to secure the coupler against the at least one of the frontside surface of the void. The base pawl is approximately parallel to the primary pawl.

DETAILED DESCRIPTION

The present disclosure is a solution for a coupler for securing an object to a structural support member through a void. In the solution, a coupler can be designed to be inserted into a void, to be removable and releasable, such that the coupler is able to be continuously reused. In one contemplated use, the coupler can secure a top to a box, where both the box and the top include a void for locking (e.g., such as BOXA-LOCKS). For example, numerous boxes, totes, and storage containers are two-part enclosure systems having a void through which a removable top is secured, when a coupler is placed in the void. In one embodiment, coupler can include two fasteners connected together via a trunk structure. In the embodiment, each fastener can be secured into voids in opposing sides of a container. In one configuration of the embodiment, when the fasteners are secured into the voids, the coupler can add structural support to the container.

Figure 1A:
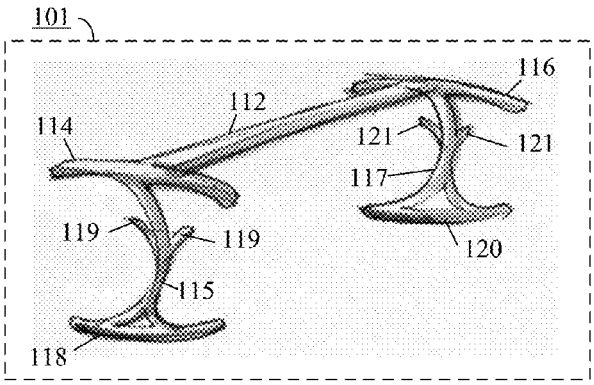
FIGS. 1A, 1B, 1C, 1D, and 1E are schematic diagrams illustrating a set of embodiments for a coupler for securing an object to a structural support member through a void in accordance with an embodiment of the inventive arrangements disclosed herein.
Figure 1B:
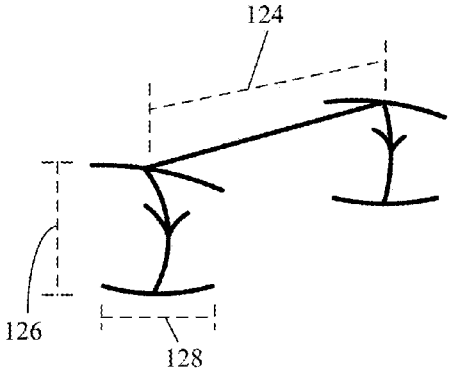
Figure 1C:
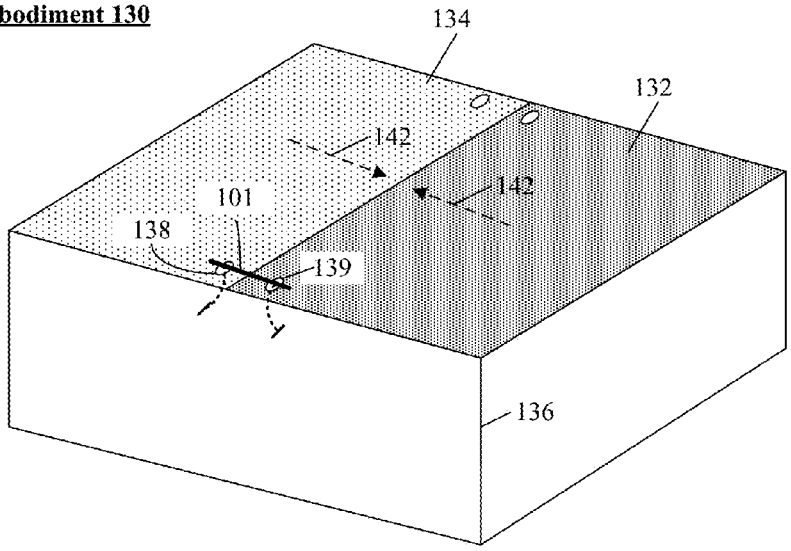

FIGS. 1A, 1B, and 1C are schematic diagrams illustrating a set of embodiments 110, 130 for a coupler for securing an object to a structural support member through a void in accordance with an embodiment of the inventive arrangements disclosed herein.

Embodiments of the coupler are detailed hereafter. Derivative and alternatives are contemplated, and the disclosure is not to be construed as limited to specifics provided herein, which serve to illustrate key features of the coupler to one of ordinary skill in the art.

As used herein, a void 138, 139 can be an opening within a supporting structure enabling insertion of one or more fasteners 115, 117. A void 138, 139 can include, but is not limited to, an aperture, a locking port, a hole, and the like. In one instance, void 138, 139 can be a locking port of a storage container, a storage box, and the like. For example, void 138, 139 can include two matching locking ports on a cardboard storage box and lid. In one embodiment, void 138, 139 can include an opening within a structural member which can facilitate fasteners 115, 117. For example, void 138, 139 can be two separate one inch holes within a sheer wall of a house.

Coupler 101 can be a device able to fit into a void 138, 139 to provide fastening and/or support. Coupler 101 can include an interior height, an exterior height, a depth, and a width. It should be appreciated that coupler 101 geometry and/or size can arbitrarily large/small. Coupler 101 can be inserted into void 138, 139 resulting in a portion of the coupler 101 residing behind the void, a portion residing within the void 138, 139, and a portion residing in front of the void. That is, coupler 101 can include an insertable portion 118, 120 which when inserted into void 138, 139 (e.g., within a box concavity) can be non-visible. Coupler 101 can include a non-insertable portion which can be visible when the coupler 101 is inserted into the void 138, 139. Coupler 101 can include, but is not limited to, a removable fastener, a disposable fastener, and the like. In one instance, coupler 101 can be inserted into one or more locking ports of a container. In one configuration of the instance, the coupler 101 can be removed non-destructively without affecting the structural integrity of the coupler 101 and/or fasteners 115, 117. In another configuration of the instance, the coupler 101 can be destroyed during removal.

Coupler 101 and/or fastener 115, 117 materials can include, but is not limited to, plastic, metal, composites, and the like. Composites can include, but is not limited to, FR-4/G10, Polyarylamide (PARA), Thermoplastics Polyurethane (TPU), Nylon, Poly Vinyl Chloride (PVC), and the like. For example, coupler 101 can be a semi-flexible TPU reusable container lock. It should be appreciated that coupler 101 can meet or exceed traditional and/or proprietary industry and/or safety standards. For example, the tensile strength of coupler 101 can be approximately equivalent to off-the-shelf fasteners (e.g., ZipTies, plastic snaps, etc). Coupler 101 properties can include, but is not limited to, can be heat-resistant, corrosion resistant, and the like.

A pawl 114, 116, 118, 119, 120, 121 can be a structure for limiting movement of the coupler in one direction. For example pawl 119, 121 can prevent coupler 101 from being removed from two voids once inserted into the voids. It should be appreciated that pawl 114, 116, 118, 119, 120, 121 can conform to any shape or geometry. For example, pawl 119, 121 can buttress against the interior portion of box lid 132, 134 to prevent removal and pawl 114, 116 can buttress against the exterior wall of lid 132, 134 to prevent coupler 101 from being inserted further into void 138, 139. That is, in one instance, coupler 101 can be inserted and cannot be removed without destroying the coupler 101. In one embodiment, pawl 114, 116, 118, 119, 120, 121 can deform allowing coupler 101 to be removed from void 138, 139 once inserted.

In embodiment 110, a coupler 101 can include a semi-rigid support member 112 with two fastener ends 115, 117 which can be secured through two voids of opposing sides of a container (e.g., container 136). In one instance, coupler 101 can be have a main handle region 112 and two ratchet fasteners 115, 117 which can each be securely fitted into a void of a container lid (e.g., 132, 134). For example, the fasteners 115, 117 can be connected to the coupler 101 to form a shape similar to the Greek letter pi (e.g., "Π"). In one embodiment, the coupler 101 can include dimensions such as a height 126, a width 128, and a length 124. Coupler 101 dimensions can vary from embodiments described herein. It should be appreciated that fasteners 115, 117, can be uniform (e.g., uniform shape, size) or non-uniform. For example, coupler 101 can include fasteners 115, 117 which are oriented in opposing directions.

In one instance, coupler 101 can include member 112 which can function as a handle to insert and/or remove coupler 101 from one or more voids. In one embodiment, fasteners 115, 117 can be perpendicular to the member 112 and be curved (e.g., outwardly, inwardly) to improve insertion and/or removal. For example, fasteners 115, 117 can be slightly curved outward, away from each other to improve the fastening strength of the coupler 101.

In embodiment 130, coupler 101 can be inserted into two voids 138, 139 of container 136. Container 136 can be a storage box for storing objects which can include or lack a lid (e.g., 132, 134). Container 136 can include an interior cavity, a trilateral grip, a partition, a lid, and the like. For example, container 136 can be a corrugated box with a two part hinged lid with locking ports (e.g., 138, 139) on each lid. In one embodiment, when coupler 101 is inserted into voids 138, 139 of container 136, the coupler can enhance the structural integrity (e.g., rigidity) of the container 136. For example, the coupler 101 can draw the lids 132, 134 together (e.g., compressive force 142) to strengthen the upward facing surface created by the lids 132, 134, increasing the weight the surface can support.

Drawings presented herein are for illustrative purposes only and should not be construed to limit the invention in any regard. Although the embodiment 110, 130 is provided as an example of use of the void-filling, reusable coupler, other use case situations are contemplated and the disclosed coupler is not to be limited to the above use case. Instead, the coupler can be utilized in a variety of situations, where a structural member including a pair of voids is to be coupled to another object. For example, in a picture hanging scenario, the void containing structural element can be a wall which can support the coupler 101 allowing the coupler to provide a support element 112 parallel to the surface of the wall. The coupler detailed herein can be passed through the void in the wall and utilized to secure a void containing item to the wall (e.g., the coupler passes through both voids) and/or used to hold an object (e.g., such as a picture) in place relative to the wall. The coupler can also function as a bar support element (e.g., permitting a hanging of objects from a support element extending from the wall) that passes through a wall (e.g., securing structure having a fixed void).

Figure 1D:
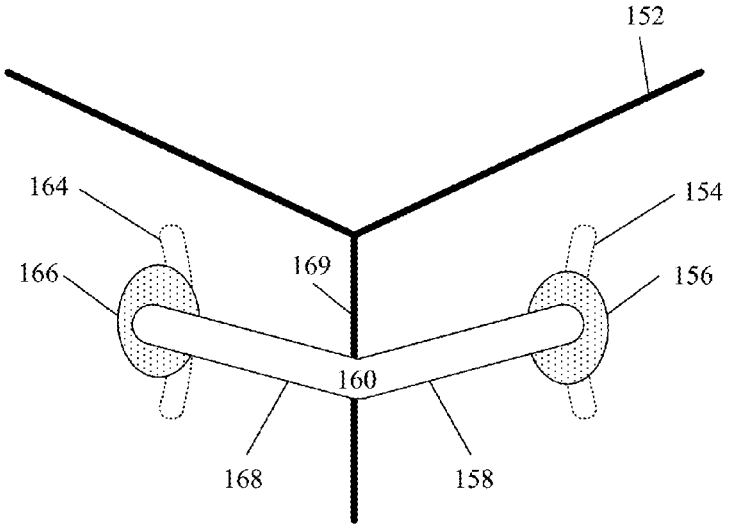
Figure 1E:
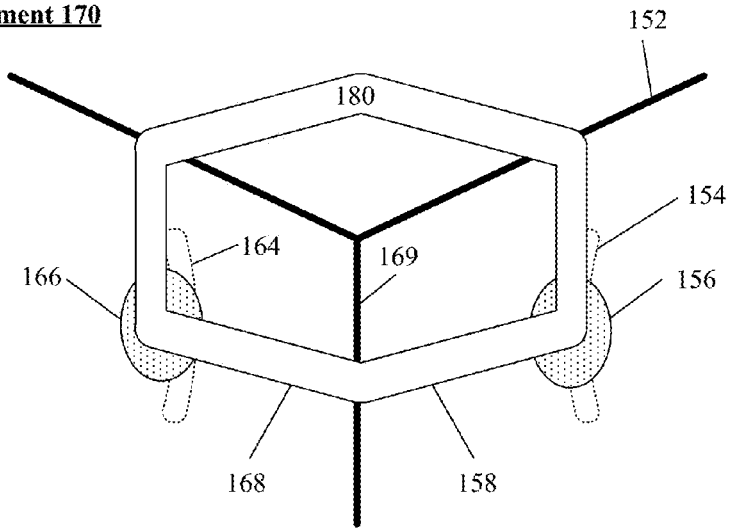

FIGS. 1D and 1E are schematic diagrams illustrating a set of embodiments 150, 170 for a coupler for securing an object to a structural support member through a void in accordance with an embodiment of the inventive arrangements disclosed herein.

Embodiment 150 illustrates a coupler 160 with a shape different from coupler 101, but performs similar functionality. In the embodiment, a coupler 160 can be inserted into two voids 166, 156, each on opposing walls of a container 152. In one instance, the coupler 160 can have a ninety degree bend in the member 112 enabling the coupler to fit against the corner 169 of container 152 via fastener 164, 154 within void 166, 156. In the instance, coupler member 112 can provide added rigidity to corner 169 by bracing the corner from force applied to the corner (e.g., from weight inside the container). For example, force approximately perpendicular to the corner from objects within the container can be substantially counteracted via coupler members 168, 158.

Embodiment 170 illustrates a coupler 160 with a shape different from coupler 101, but performs similar functionality. In the embodiment, a coupler 180 can be inserted into two voids 166, 156, each on opposing walls of a container 152. In one instance, the coupler 180 can have a complex shape for the member 112 enabling the coupler to fit against the corner 169 of container 152 via fastener 164, 154 within void 166, 156. For example, the coupler 180 can rest on the top of container (e.g., against a lid) and extend over each side of the corner 169 and down (e.g., parallel to side walls) to meet portions 168, 158. In the instance, coupler member 112 can provide added rigidity to corner 169 by bracing the corner and/or lid from force applied to the corner (e.g., from weight inside the container). For example, force approximately perpendicular to the side walls and/or lid from objects within the container can be substantially counteracted via coupler member 180.

Figure 2A:
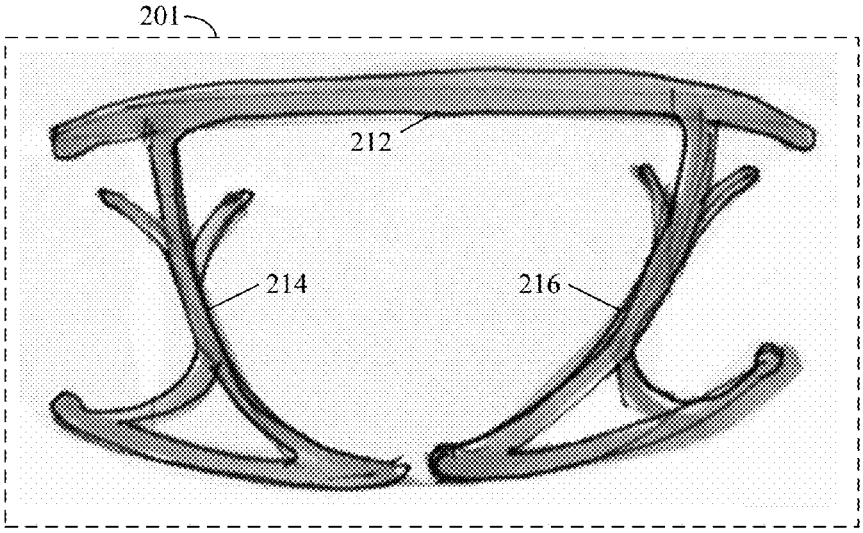
FIGS. 2A and 2B are schematic diagrams illustrating a set of embodiments for a coupler for securing an object to a structural support member through a void in accordance with an embodiment of the inventive arrangements disclosed herein.
Figure 2B:
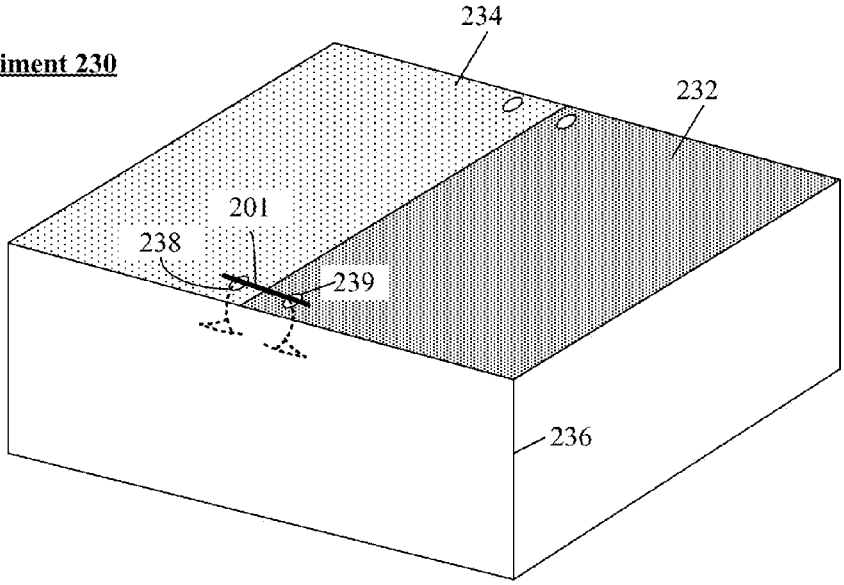

FIGS. 2A and 2B are schematic diagrams illustrating a set of embodiments 210, 230 for a coupler for securing an object to a structural support member through a void in accordance with an embodiment of the inventive arrangements disclosed herein.

In embodiment 210, a coupler 201 can include a semi-rigid support member 212 with two fastener ends 214, 216 which can be secured through two voids of opposing sides of a container (e.g., container 236). In one instance, coupler 201 can be have a main handle region 212 and two converging ratchet fasteners 214, 216 which can each be securely fitted into a void of a container lid (e.g., 232, 234). For example, coupler 201 can include fasteners 214, 216 with primary pawls pointed towards each other with a distance of one centimeter between them.

In one instance, coupler 201 can include member 212 which can function as a handle to insert and/or remove coupler 201 from one or more voids. In one embodiment, fasteners 214, 216 can be perpendicular to the member 212 and be curved (e.g., inwardly) to improve insertion and/or removal. For example, the primary pawl of fasteners 214, 216 can be slightly curved inward, toward each other to improve the fastening strength of the coupler 201. In one embodiment, removing coupler 201 can cause fasteners 214, 216 to be pulled together inhibiting and/or preventing removal of coupler 201 from voids 238, 239.

In embodiment 230, coupler 201 can be inserted into two voids 238, 239 of container 236. In the embodiment, when coupler 201 is inserted into voids 238, 239 of container 236, the coupler 201 can enhance the structural integrity (e.g., rigidity) of the container 236 lid. For example, the coupler 201 can draw the lids 232, 234 together to strengthen the upward facing surface created by the lids 232, 234, increasing the weight the surface can support.

Drawings presented herein are for illustrative purposes only and should not be construed to limit the invention in any regard. It should be appreciated that coupler 201 can be inserted into voids of opposing sides of container and is not limited to the arrangement described herein. It should be appreciated that coupler 201 can be inserted into voids of container in any arbitrary manner. For example, coupler 201 can be secured at an angle to a top edge of container 236. That is, the coupler 201 need not be parallel and/or perpendicular to container 236 surfaces.

Figure 3A:
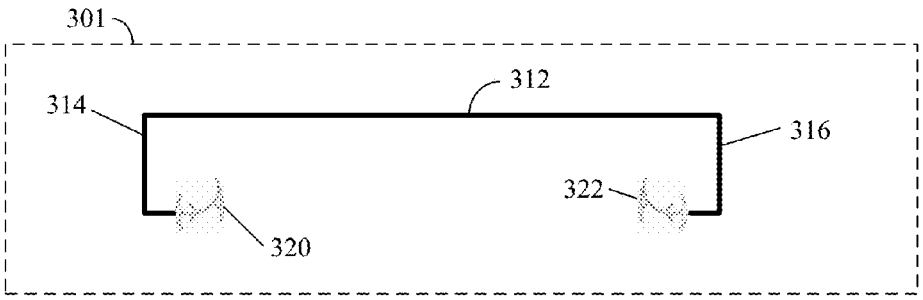
FIGS. 3A and 3B are schematic diagrams illustrating a set of embodiments for a coupler for securing an object to a structural support member through a void in accordance with an embodiment of the inventive arrangements disclosed herein.
Figure 3B:
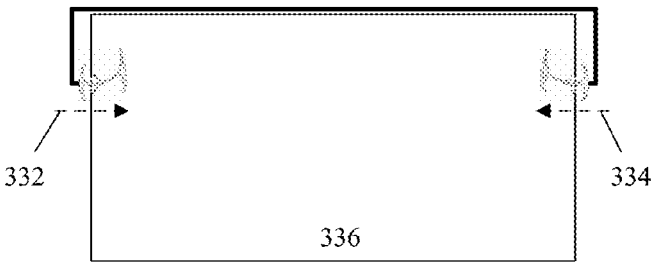

FIGS. 3A and 3B are schematic diagrams illustrating a set of embodiments 310, 330 for a coupler for securing an object to a structural support member through a void in accordance with an embodiment of the inventive arrangements disclosed herein.

In embodiment 310, 330, a coupler 301 can include an elastic support member 312 which can terminate at each end with a fastener 320, 322. In one embodiment, member 312 can be a partial loop which can permit fastener 320, 322 to fit into opposing voids of a container (e.g., 336) securely. For example, member 312 length can conform to the approximate width of a container enabling the coupler 301 to be snap fitted into voids of either side of container (e.g., container 330) by temporarily deforming the sides 314, 316 outward to fit around the side walls of container 330. In one instance, member 312 can be sufficiently rigid to enable fasteners 320, 322 to exert force 332, 334 against side walls of container 336, enhancing the structural rigidity of the container.

Drawings presented herein are for illustrative purposes only and should not be construed to limit the invention in any regard. It should be appreciated that coupler 301 can be fastened into voids of container 336 in any arbitrary manner. For example, coupler 301 can be secured against the side walls of the box (e.g., around the side) to reinforce side wall stability.

Figure 4A:
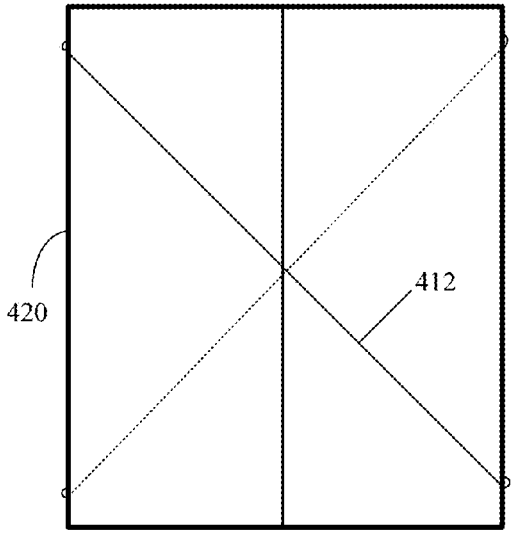
FIGS. 4A and 4B are schematic diagrams illustrating embodiments for a coupler for securing an object to a structural support member through a void in accordance with an embodiment of the inventive arrangements disclosed herein.
Figure 4B:
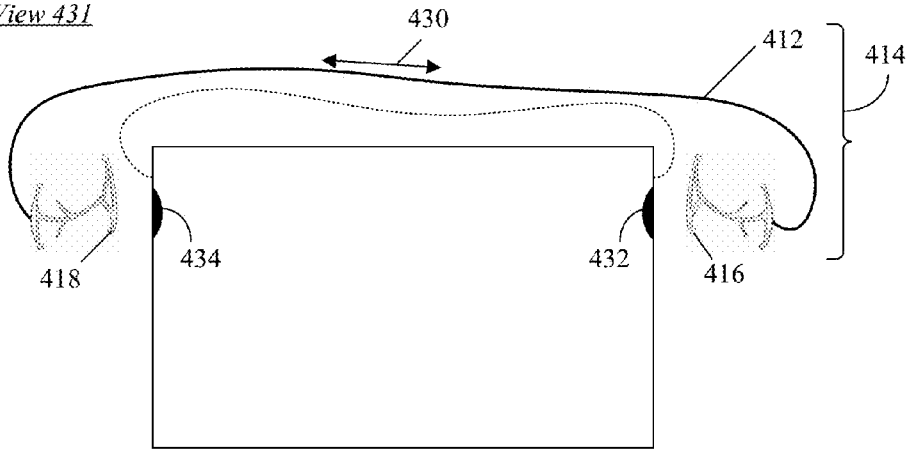

FIGS. 4A and 4B are schematic diagrams illustrating an embodiment 410 for a coupler for securing an object to a structural support member through a void in accordance with an embodiment of the inventive arrangements disclosed herein.

Embodiment 410 illustrates a top view 411 and a side view 431 of an elastic coupler 414 which can be secured to two opposing voids within opposing side walls of a container 420. In one embodiment, coupler 414 can include an elastic portion 412 which can terminate at each end with a fastener 416, 418. In one instance, member 412 can be stretched 430 from a void 432 to a diagonally opposed void 434 permitting each end 416, 418 to be secured into each void 432, 434. For example, two couplers can be utilized to secure a container through voids at diagonally opposing ends (e.g., forming a cross in the center). In one instance, coupler 414 can enhance the structural rigidity of the container 420.

In one embodiment, member 412 can conform to one or more elastic strands forming a core which can be covered in a woven cotton or polypropylene sheath. The sheath can lack extensibility, but braided strands spiraling around the core can enable a longitudinal extension which can cause the strands to squeeze the core, transmitting the core's elastic compression to the longitudinal extension of the sheath and cord. For example, member 412 can conform to an elastic member of a bungee cord able to increase in length from an original length. In one instance, member 412 can be temporarily stretched to be coupled to void 432, 434. In the embodiment, the member 412 can return to its original length when decoupled from container 420.

Drawings presented herein are for illustrative purposes only and should not be construed to limit the invention in any regard. In one embodiment, fasteners 416, 418 can have different shapes and/or sizes. For example, fastener 416 shape can conform to a compound shape (e.g., coupler 101) and fastener 418 can conform to a simple shape. It should be appreciated that coupler 414 can be arbitrarily fastened to the container. In one embodiment, coupler 414 can be secured against the side walls of container 420, against the base (e.g., from the underside), and the like.

Figure 5A:
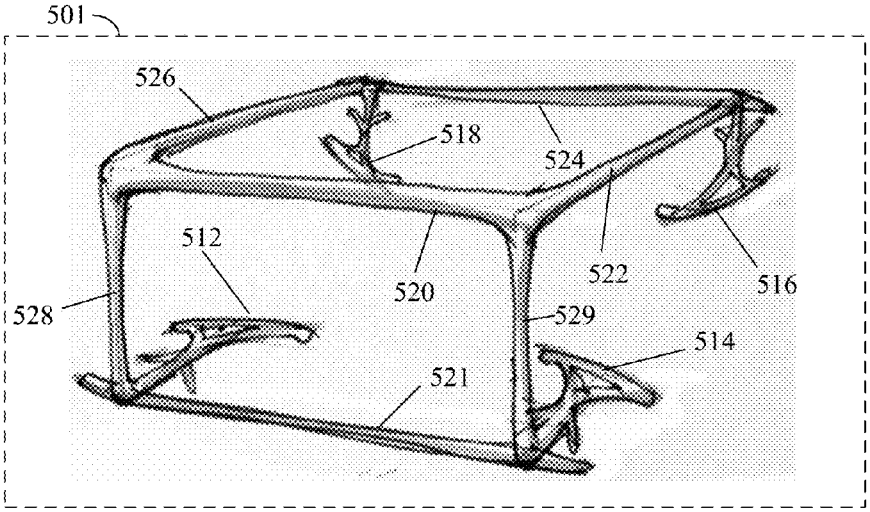
FIGS. 5A and 5B are schematic diagrams illustrating a set of embodiments for a coupler for securing an object to a structural support member through a void in accordance with an embodiment of the inventive arrangements disclosed herein.
Figure 5B:
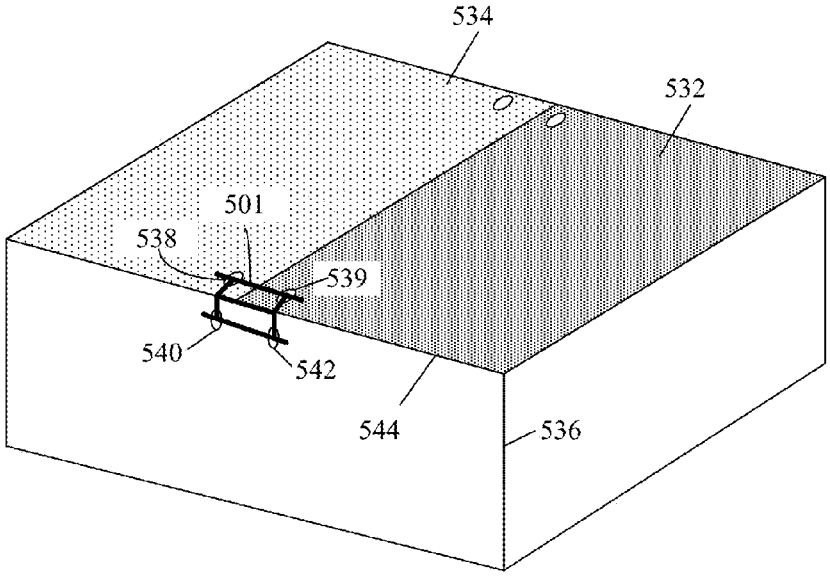

FIGS. 5A and 5B are schematic diagrams illustrating an embodiment 510 for a coupler for securing an object to a structural support member through a void in accordance with an embodiment of the inventive arrangements disclosed herein.

In embodiment 510, 530, a coupler 501 can include a semi-rigid support member 520 with multiple fastener ends 512, 514, 516, 518 which can be secured through multiple voids of opposing sides of a container (e.g., container 536). For example, coupler 501 can conform to a partial platonic solid such as a cube with two "faces" each being formed by support 520, 522, 524, 526 and 520, 521, 518, 529. In one instance, coupler 501 can be have multiple main handle regions 524, 520, 521 and multiple ratchet fasteners 512, 514, 516, 518 which can each be securely fitted into voids 538, 539 of a container lid (e.g., 532, 534) and voids of container side wall 540, 542. For example, the fasteners can permit the coupler 501 to be secured a top edge 544 of a container 536.

In one instance, fasteners 512, 514, 516, 518 can be oriented to maximize coupling. In one embodiment, primary pawl of fasteners 512, 514 can be oriented parallel to lid and fasteners 516, 518 can be oriented perpendicular to the side walls of container 536. It should be appreciated that the embodiment 510, 530 is not limited to the exact orientation and structure described herein and can vary based on real world constraints (e.g., container shape, size, etc). It should be appreciated that the coupler 501 of embodiment 510, 530 can enhance the structural integrity of the container 536 when the coupler is properly fastened to through the voids of the container.

Drawings presented herein are for illustrative purposes only and should not be construed to limit the invention in any regard. In one embodiment, coupler 501 can be utilized as a bracing element. For example, coupler 501 can be secured against each of the outside corners of container 536 to reinforce corner rigidity.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A container fastener comprising:

a coupler having at least one semi-rigid support member and at least two extrusions, wherein the at least two extrusions are secured against opposing sides of a container, wherein each of the at least two extrusions is fitted through a void on each of the opposing sides of the container, wherein the coupler provides structural support to the container when the at least two extrusions are securely fitted into the voids, wherein each of the at least two extrusions comprises at least an insertable end, a non-insertable end, a trunk, and a set of tertiary pawls extending from at least one of the trunk and a primary pawl, wherein the tertiary pawls are positioned between the insertable end and the non-insertable end along a longitudinal axis of the coupler, wherein the insertable end is able to fit through a respective void from a frontside through the respective void to a backside of the respective void, wherein the non-insertable end is not able to fit through the void, wherein the trunk terminates at the insertable end in the primary pawl, wherein when the tertiary pawls are completely inserted into the respective void, the tertiary pawls contact a backside surface associated with the respective void, wherein the non-insertable end terminates in a base pawl, wherein the base pawl is able to secure the coupler against a frontside surface associated with the respective void, wherein the base pawl is approximately parallel to the primary pawl.

2. The container fastener of claim 1, wherein the trunk is able to be temporarily deformed during fastening.

3. The container fastener of claim 1, wherein the trunk is longitudinally extensible.

* * * * *